US005154065A

United States Patent [19]

Herman

[11] Patent Number: 5,154,065

[45] Date of Patent: Oct. 13, 1992

[54] COMBINATION SUBATMOSPHERIC PRESSURE SWING FILTER AND REFRIGERATION SYSTEM

[75] Inventor: Gerald J. Herman, Farmington Hills, Mich.

[73] Assignee: Williams International Corporation, Walled Lake, Mich.

[21] Appl. No.: 725,776

[22] Filed: Jul. 2, 1991

[51] Int. Cl.[5] ..... F25D 9/00

[52] U.S. Cl. ..... 62/401; 62/86; 62/89

[58] Field of Search ..... 62/86, 87, 88, 89, 199, 62/401, 402

[56] References Cited

U.S. PATENT DOCUMENTS

| | | | |
|---|---|---|---|
| 3,856,493 | 12/1974 | Bulkley | 62/401 |
| 4,263,786 | 4/1981 | Eng | 62/402 |
| 4,430,867 | 2/1984 | Warner | 62/402 |
| 4,434,624 | 3/1984 | Cronin et al. | 62/402 |

*Primary Examiner*—Ronald C. Capossela
*Attorney, Agent, or Firm*—Lyon & Delevie

[57] ABSTRACT

A subatmospheric pressure swing filter is integrated with a vapor cycle refrigeration system so as to provide both air filtration and air conditioning.

4 Claims, 1 Drawing Sheet

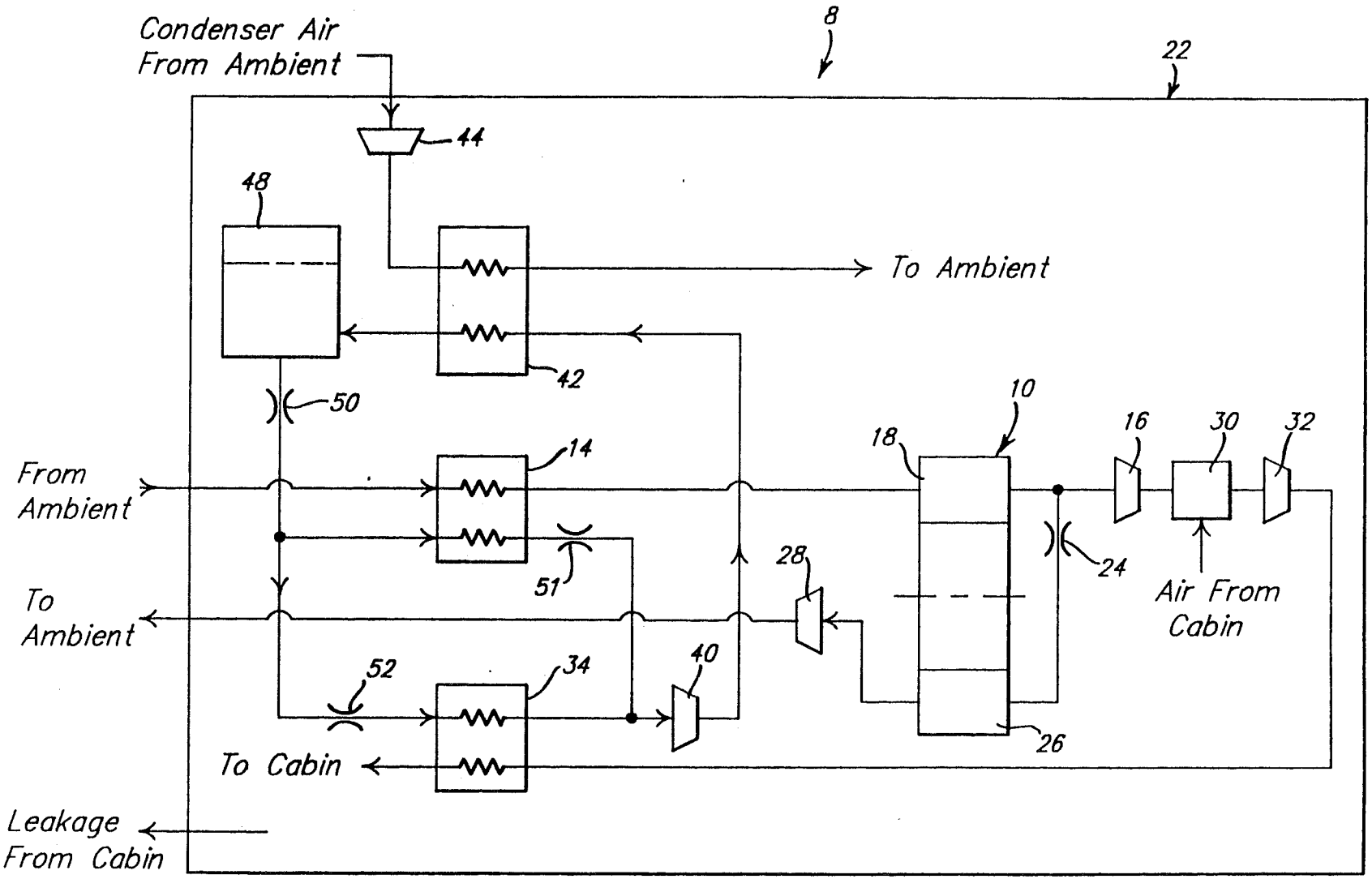
8
22
10
18
26
24
16
30
32
Air From Cabin
To Ambient
28
40
42
14
51
34
44
48
50
52
Condenser Air From Ambient
From Ambient
To Ambient
To Cabin
Leakage From Cabin

COMBINATION SUBATMOSPHERIC PRESSURE SWING FILTER AND REFRIGERATION SYSTEM

BACKGROUND OF THE INVENTION

Pressure swing air filters operate by passing contaminated air at a pressure above ambient pressure through an absorbent material that removes impurities from the air. A portion of the cleansed air is then reversed through the filter at a relatively lower pressure to purge the impurities from the filter. Known systems require compression and expansion of the entire air flow and therefore are characterized by relatively high power consumption.

SUMMARY OF THE INVENTION

The instant invention relates to a subatmospheric pressure swing filter that operates between pressures of one fifth of an atmosphere and one atmosphere instead of the heretofore known pressure range of from one atmosphere to five atmospheres. The system reduces the power required to maintain the required pressure differential since work must be performed on only purge air to produce the desired 5:1 ratio in contradistinction to known high pressure systems wherein the entire air flow must be compressed.

The aforesaid problem with respect to power requirements is further minimized by combining the subatmospheric pressure swing filter with a vapor cycle refrigeration system for air conditioning. Such a combination of systems uses substantially less power, on a net basis, than known combinations using an air cycle cooling system.

Moreover, since refrigeration is not always required, the vapor cycle system can be turned off and the subatmospheric pressure swing filter can be operated independently.

BRIEF DESCRIPTION OF THE DRAWING

The drawing comprises a schematic diagram of a combination subatmospheric pressure swing filter and vapor cycle refrigeration system in accordance with a preferred embodiment of the present invention.

DETAILED DESCRIPTION OF THE INVENTION

The instant invention comprises a combination rotary subatmospheric pressure swing filter and vapor cycle refrigeration system 8. Atmospheric air is drawn into a filter 10 through a small evaporator 14 which cools the incoming air to approximately 50° F., thereby removing most of the moisture from the air. A blower 16 draws filtered and dehumidified air from an absorbing side 18 of the rotary subatmospheric pressure swing filter 10 for introduction into, for example, a vehicle cabin 22.

While most of the air from the filter 10 goes to the cabin 22, a portion of the purified air is drawn through an orifice 24 and then through a purge side 26 of the filter 10 by a vacuum pump 28. The vacuum pump 28 drops the pressure in the purge side 26 of the filter 10 to about 1/5 of the pressure on the cleaning side 18 thereof. Since air passing through the pure side 26 of the filter 10 comprises a portion of the air that passes through the filtering side 18 thereof, its temperature will be substantially the same. Moreover, because air is almost an ideal gas its temperature does not change when passing through the orifice 24. Thus, because the pressure of air in the purge side 26 of the filter 10 is about 1/5 that of the pressure of air in the cleaning side 18, only 1/5 of the mass flow is evidenced on the purge side 26 of the filter 10.

Most of the filtered air is directed, to a mixer 30 in the cabin 22 where the partially cooled, dry, clean air is mixed with compartment air. The mixed air is drawn from the mixer 30 by a recirculation blower 32, then further cooled in an evaporator 34 which absorbs, for example, in an exemplary system discussed hereinafter, 27,000 BTU/hr heat load on a continuous basis. The cooled air is then discharged into the cabin 22. While a portion of the air leaks from the cabin 22 to ambient, the bulk of the air is returned to the mixer 30. The air that leaks from the cabin 22 is replaced by clean air from the subatmospheric pressure swing filter 10.

The vapor cycle portion of the system 8 used to cool the two evaporators 14 and 34, uses Freon R113 as the working fluid. The vapor cycle system 8 comprises a compressor 40, connected in the conventional manner to a condenser 42, receiver 48, thence to the evaporators 14 and 34 for return to the compressor 40. Ambient air is ducted from a condenser blower 44 to the condenser 42, thence is returned to ambient. The two evaporators 14 and 34 can be separately controlled for temperature and capacity by a set of orifices 50, 51 and 52.

The overall power requirement for the system can be computed and sized up or down with system components retaining the same percentage size relationship to the following components. In a preferred embodiment of the invention the system was sized on the basis of a 12 horsepower refrigeration compressor. On this basis, the vacuum pump 28 requires 4 horsepower. The air blower 16, recirculation blower 32, and condenser blower 44 exhibit a total consumption of approximately 6 horsepower. Since the compressor 40 of the vapor cycle system consumes 12 horsepower, the total power requirement of the disclosed embodiment of the invention is 22 horsepower. This power requirement represents a significant saving over that of known ambient pressure swing filter systems of like capacity when the refrigeration component is considered.

While the preferred embodiment of the invention has been disclosed, it should be appreciated that the invention is susceptible of modification without departing from the scope of the following claims.

I claim:

1. A subatmospheric pressure swing filter and refrigeration system for an enclosure comprising;
   - a refrigeration compressor having an inlet and an outlet,
   - a condenser having a first inlet connected to the outlet of said compressor,
   - a receiver having an inlet connected to a first outlet of said condenser,
   - a first evaporator having an inlet connected to an outlet of said receiver and to the inlet of said compressor,
   - a second evaporator having an inlet connected to the outlet of said receiver and to the inlet of said compressor,
   - a rotary pressure swing filter having an air filtration side and a purge side,
   - a blower for compressing air from an outlet of said first evaporator and connected to an inlet to the filtration side of said pressure swing filter,
   - a purge air orifice having an inlet connected to an outlet of the filtration side of said filter and an outlet connected to an inlet to the purge side of said filter, a vacuum pump connected to an outlet of the purge side of said filter for maintaining subatmospheric pressure in the purge side of said filter, a recirculation blower having an inlet connected to the outlet of the filtration side of said filter and an outlet connected to said second evaporator, and a condenser blower having an inlet connected to ambient and an outlet connected to said condenser.

2. The system of claim 1 wherein a mixer is interposed between the outlet of the purification side of said filter and said recirculation blower.

3. The system of claim 1 including a second orifice connected to the outlet of said first evaporator and said compressor.

4. The system of claim 3 including a third orifice connected between the outlet of said receiver and the inlet to said compressor.

* * * * *